US007857096B2

(12) United States Patent
Latimer et al.

(10) Patent No.: US 7,857,096 B2
(45) Date of Patent: Dec. 28, 2010

(54) STEEL PUMP JACK WITH SAFETY LATCH AND METHOD

(75) Inventors: Brett A. Latimer, Mercer, PA (US); Robert D. Beggs, Mercer, PA (US)

(73) Assignee: Werner Co., Greenville, PA (US)

( * ) Notice: Subject to any disclaimer, the term of this patent is extended or adjusted under 35 U.S.C. 154(b) by 1238 days.

(21) Appl. No.: 11/257,242

(22) Filed: Oct. 24, 2005

(65) Prior Publication Data

US 2007/0267610 A1 Nov. 22, 2007

(51) Int. Cl.
*E04G 1/18* (2006.01)

(52) U.S. Cl. ..... 182/133; 182/134; 182/135; 182/136

(58) Field of Classification Search ..... 182/133–136, 182/182.4, 187; 248/244, 221.1, 222.1; 16/352, 16/357, 362
See application file for complete search history.

(56) References Cited

U.S. PATENT DOCUMENTS 1,349,426 A * 8/1920 Kitsteiner, Jr. ..... 182/146
1,832,394 A * 11/1931 Holmboe ..... 254/104
2,703,431 A * 3/1955 Tatom ..... 16/258
2,897,013 A * 7/1959 Delp ..... 52/645
3,270,997 A * 9/1966 Gethmann ..... 248/235
3,473,774 A * 10/1969 Riblet ..... 248/246
4,432,435 A * 2/1984 Anderson ..... 182/82
4,446,945 A * 5/1984 Anderson ..... 182/229
4,463,828 A * 8/1984 Anderson ..... 182/136
4,502,565 A * 3/1985 Koffski ..... 182/182.4
4,597,471 A * 7/1986 Anderson ..... 182/136
4,942,941 A * 7/1990 Anderson ..... 182/136
4,961,478 A * 10/1990 Anderson ..... 182/229
5,020,634 A * 6/1991 Gunderson et al. ..... 182/182.4
5,542,776 A * 8/1996 Reynolds ..... 403/389
5,915,765 A * 6/1999 Sternberger ..... 292/256.69
6,702,509 B2 * 3/2004 Rogers ..... 403/385
7,152,835 B1 * 12/2006 Riblet ..... 248/246
2002/0179371 A1 * 12/2002 Riblet ..... 182/136

* cited by examiner

*Primary Examiner*—Katherine W Mitchell
*Assistant Examiner*—Colleen M Quinn
(74) *Attorney, Agent, or Firm*—Ansel M. Schwartz

(57) ABSTRACT

An upper shackle assembly for a steel pump jack for a wood pole includes a u-shaped shackle component to receive the wood pole. The assembly includes a crank handle that extends through the shackle component and engages the pole to lower the pump jack down the pole. The assembly includes a brake attached to the shackle component to engage with the pole if the crank handle fails. A method for installing a steel pump jack to a wood pole includes the steps of placing a u-shaped shackle component about the wood pole. There is the step of closing a brake with the shackle component to engage with the pole if a crank handle fails. There is the step of extending the crank handle through the shackle component to engage the pole. A steel pump jack.

4 Claims, 23 Drawing Sheets

FULLY OPEN

FULLY OPEN

FULLY OPEN FRONT VIEW

FULLY OPEN BACK VIEW

FULLY OPEN RIGHT VIEW

FULLY OPEN LEFT VIEW

FULLY OPEN TOP VIEW

FULLY OPEN BOTTOM VIEW

PARTIAL OPEN

PARTIAL OPEN

PARTIAL OPEN FRONT VIEW

PARTIAL OPEN BACK VIEW

PARTIAL OPEN RIGHT VIEW

PARTIAL OPEN LEFT VIEW

PARTIAL OPEN TOP VIEW

PARTIAL OPEN BOTTOM VIEW

FULLY CLOSED

FULLY CLOSED

FULLY CLOSED FRONT VIEW

FULLY CLOSED BACK VIEW

FULLY CLOSED RIGHT VIEW

FULLY CLOSED LEFT VIEW

FULLY CLOSED TOP VIEW

FULLY CLOSED BOTTOM VIEW

LATCH PLATE

LATCH PLATE

LATCH PLATE FRONT VIEW

LATCH PLATE BACK VIEW

LATCH PLATE RIGHT VIEW

LATCH PLATE LEFT VIEW

LATCH PLATE TOP VIEW

LATCH PLATE BOTTOM VIEW

SHACKLE COMPONENT

SHACKLE COMPONENT

SHACKLE COMPONENT FRONT VIEW

SHACKLE COMPONENT BACK VIEW

SHACKLE COMPONENT RIGHT VIEW

SHACKLE COMPONENT LEFT VIEW

SHACKLE COMPONENT TOP VIEW

SHACKLE COMPONENT BOTTOM VIEW

LATCH PLATE GAP
AT WORKING ANGLE

CRANK HANDLE
POSITION AT WORKING ANGLE

LATCH PLATE CONTACT WITH
POLE AT FAILURE ANGLE

LATCH PLATE CONTACT WITH
POLE AT FAILURE ANGLE

SHACKLE COMPONENT ANGLE
WITH CRANK HANDLE

SHACKLE COMPONENT ANGLE
WITHOUT CRANK HANDLE

PUMP JACK

STEEL PUMP JACK WITH SAFETY LATCH AND METHOD

FIELD OF THE INVENTION

The present invention is related to a steel pump jack. More specifically, the present invention is related to a steel pump jack having a brake attached to a shackle component to engage with a pole if a crank handle fails.

BACKGROUND OF THE INVENTION

A Steel Pump Jack is used to transport individuals and supplies up and down a wood pole vertically in order to complete a job, such as siding or brick laying. The steel pump jack is made of formed steel parts, which are riveted or bolted together. The steel pump jack consists of side supports, platform supports, platform extension support, a lower shackle assembly and an upper shackle assembly with foot pump and boot strap. The steel pump jack also contains a formed crank handle for lowering the steel pump jack down the pole and a brake system, consisting of a lever that can be depressed using a foot.

One design presently in production consists of an upper shackle assembly that is primarily u-shaped to allow easy attachment of the steel pump jack to the wood pole. In this design, the crank handle used for lowering the steel pump jack down the pole, is susceptible to wear and could eventually break. If breakage occurs while the steel pump jack is being lowered (i.e. the foot lever is disengaged), there is nothing to keep the steel pump jack from sliding freely down the pole.

SUMMARY OF THE INVENTION

The present invention pertains to an upper shackle assembly for a steel pump jack for a wood pole. The assembly comprises a u-shaped shackle component to receive the wood pole. The assembly comprises a crank handle that extends through the shackle component and engages the pole to lower the pump jack down the pole. The assembly comprises a brake attached to the shackle component to engage with the pole if the crank handle fails.

The present invention pertains to a method for installing a steel pump jack to a wood pole The method comprises the steps of placing a u-shaped shackle component about the wood pole. There is the step of closing a brake with the shackle component to engage with the pole if a crank handle fails. There is the step of extending the crank handle through the shackle component to engage the pole.

A steel pump jack comprises two side supports with a formed flange along each edge of the side supports; two platform supports with a formed flange along each edge of the platform supports; a platform extension support with formed flanges along each edge of the platform extension support; a lower shackle assembly and an upper shackle assembly with foot pump and boot strap. The steel pump jack also contains a formed crank handle for lowering the steel pump jack down a wood pole and a brake system having a foot lever that can be depressed using a foot.

BRIEF DESCRIPTION OF THE DRAWINGS

In the accompanying drawings, the preferred embodiment of the invention and preferred methods of practicing the invention are illustrated in which.

DETAILED DESCRIPTION

Figure 1:
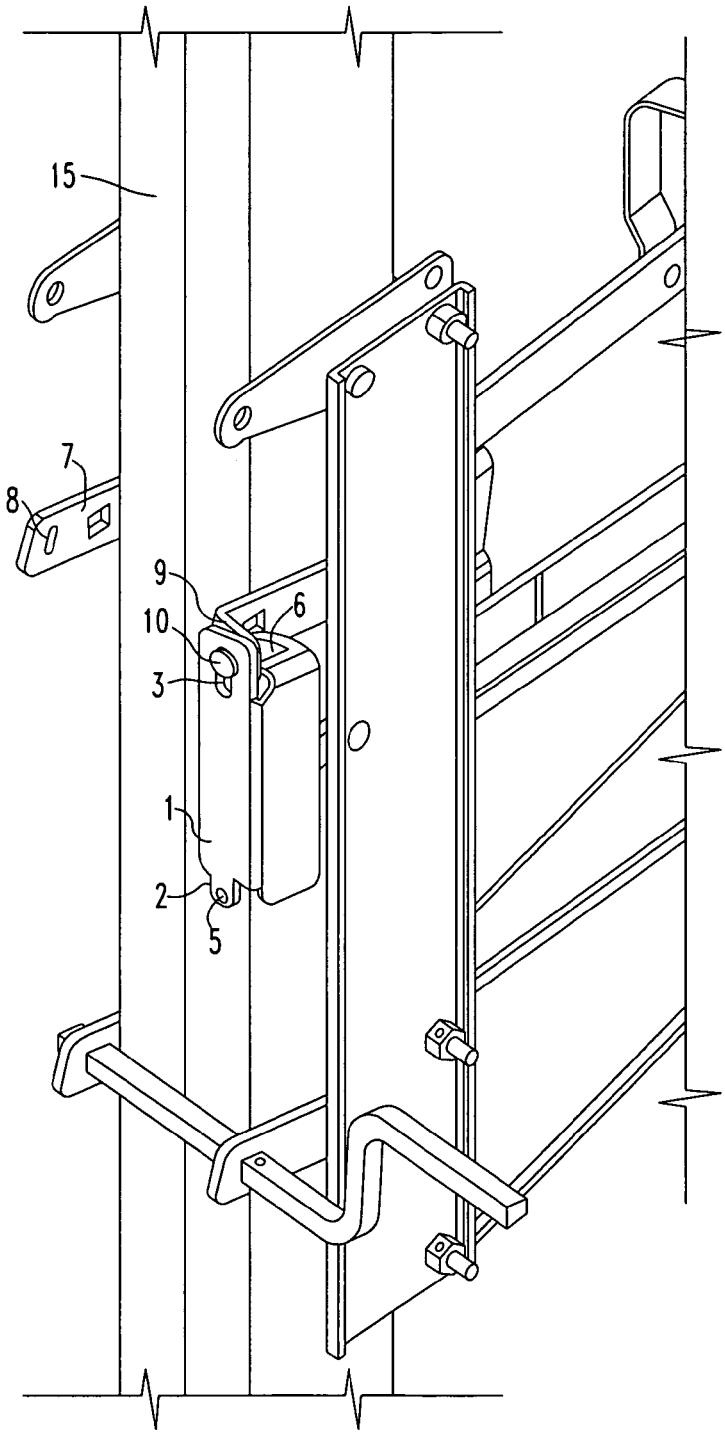
FIG. 1 shows a pump jack of the present invention in an open view.
Figure 2:
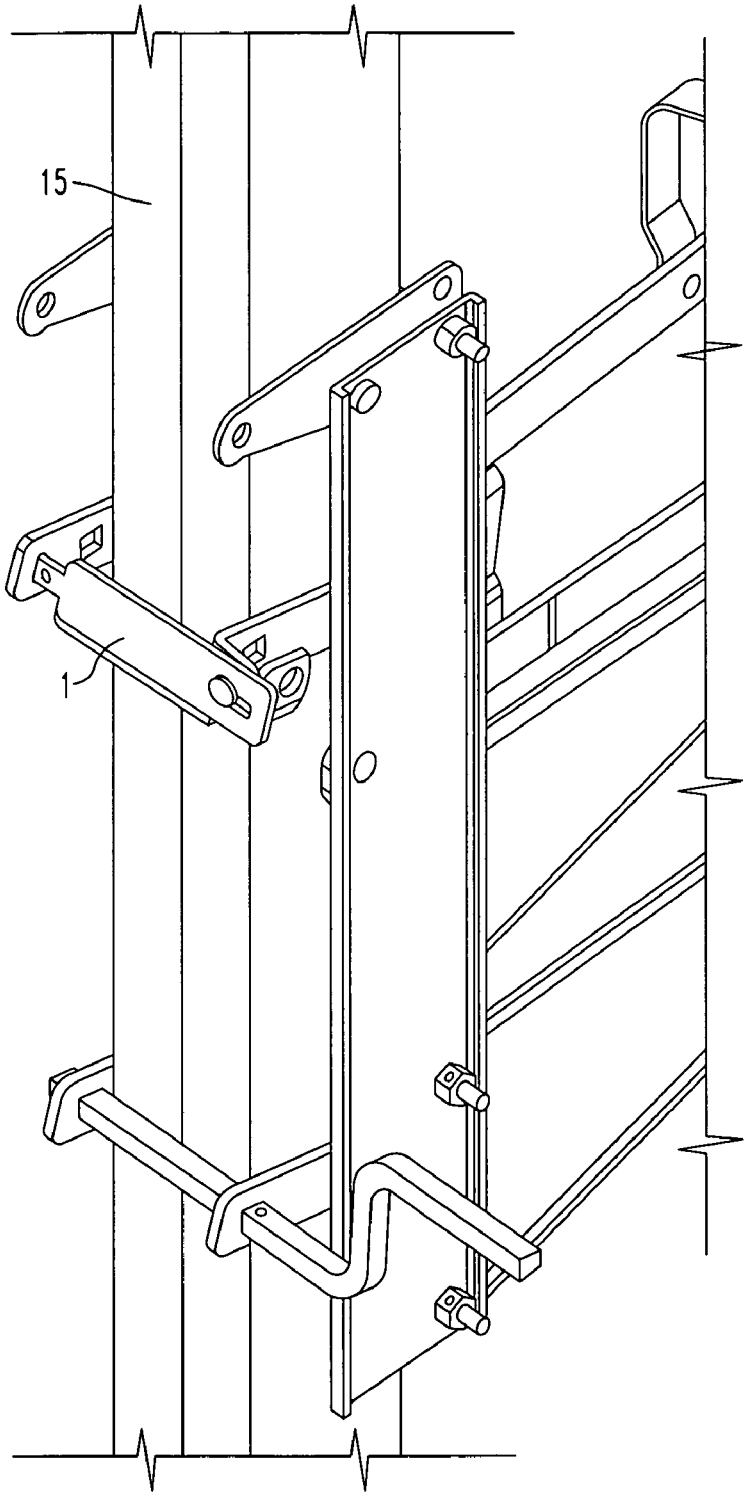
FIG. 2 shows the pump jack in a partially closed position.
Figure 3:
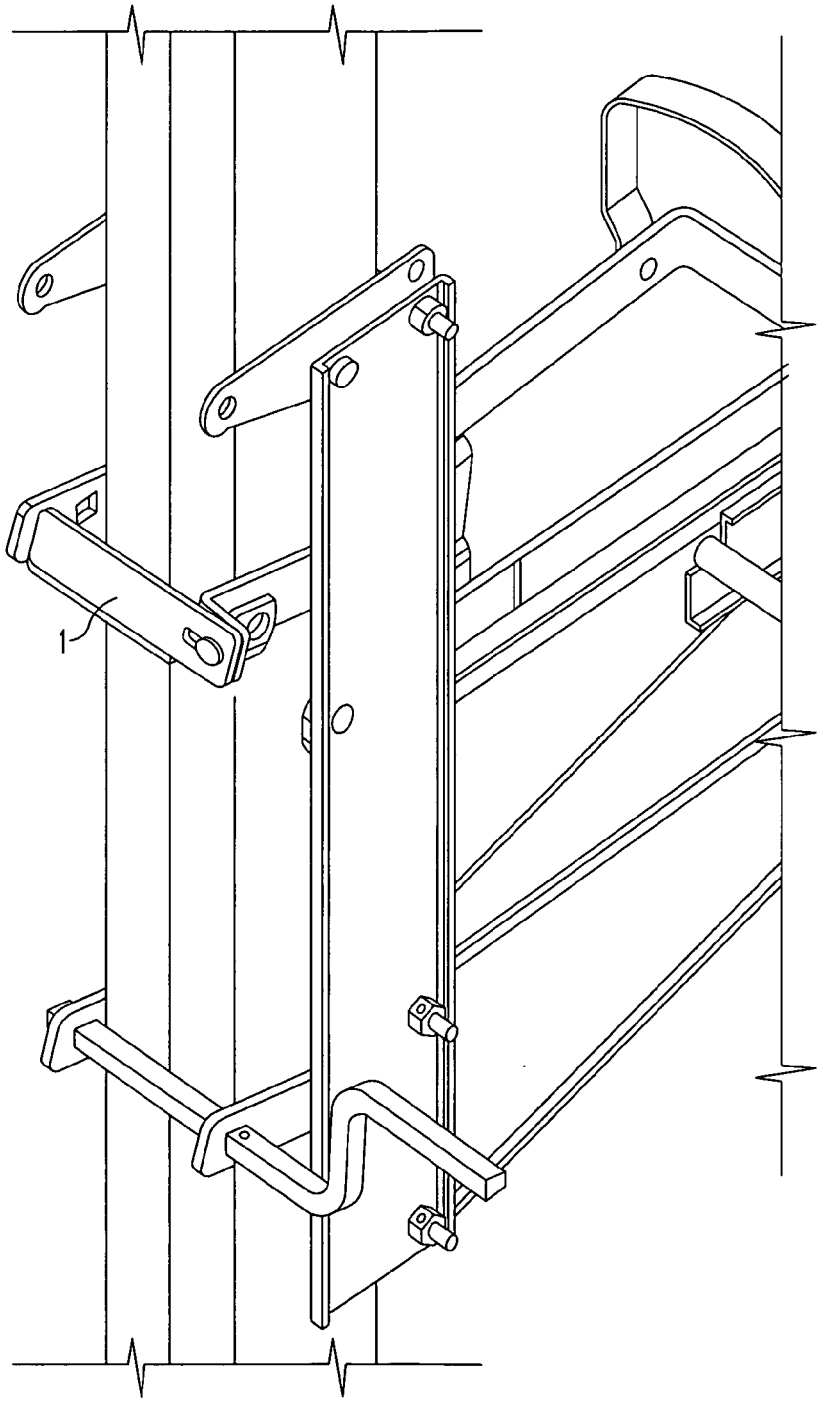
FIG. 3 shows the pump jack in a closed position.

Referring now to the drawings wherein like reference numerals refer to similar or identical parts throughout the several views, and more specifically to FIG. 1 thereof, there is shown an upper shackle assembly for a steel pump jack 50 for a wood pole 15. The assembly comprises a u-shaped shackle component 7 to receive the wood pole 15. The assembly comprises a crank handle 12 that extends through the shackle component 7 and engages the pole 15 to lower the pump jack 50 down the pole 15. The assembly comprises a brake attached to the shackle component 7 to engage with the pole 15 if the crank handle 12 fails.

Preferably, the brake includes a latch plate 1 having a first side and a second side. The first side preferably has a latch tab 2 and the second side has a slot 3 and a cover rib 4. Preferably, the latch tab 2 has a hole 5 and the cover rib 4 has a hole 6. The brake preferably includes a pin 22 which fits through the latch tab hole 5 to hold a latch plate 1 in place when the latch plate 1 is closed with the u-shaped shackle component 7. Preferably, the hole 6 in the cover rib 4 receives the end of the crank handle 12.

The latch plate 1 preferably includes a rib 4 which catches with the wood pole 15 if the crank handle 12 fails. Preferably, the shackle component 7 includes a first side with an open slot 8 through which the latch tab 2 extends in a closed position, and a second side having an attachment surface from which a rivet 10 extends through the slot 3 of the latch tab 2 so the latch plate 1 can slide and pivot with respect to the attachment surface. The second side of the shackle component 7 preferably includes a square hole 13 which is covered by the cover rib 4 when the latch plate 1 is not in the closed position and to ensure the latch plate 1 is in the closed position during use.

The present invention pertains to a method for installing a steel pump jack 50 to a wood pole 15. The method comprises the steps of placing a u-shaped shackle component 7 about the wood pole 15. There is the step of closing a brake with the shackle component 7 to engage with the pole 15 if a crank handle 12 fails. There is the step of extending the crank handle 12 through the shackle component 7 to engage the pole 15.

Preferably, the closing step includes the step of permitting the latch plate 1 of the brake from an open position to a partially closed position with the shackle component 7. The closing step preferably includes the step of sliding the latch plate 1 into a closed position where a latch plate tab 2 of the latch plate 1 is inserted into an open slot 8 of the shackle component 7. Preferably, the closing step includes the step of inserting a pin 22 into a latch plate hole of the latch plate tab 2 to hold a latch plate 1 in place with the shackle component 7 during use.

Figure 51:
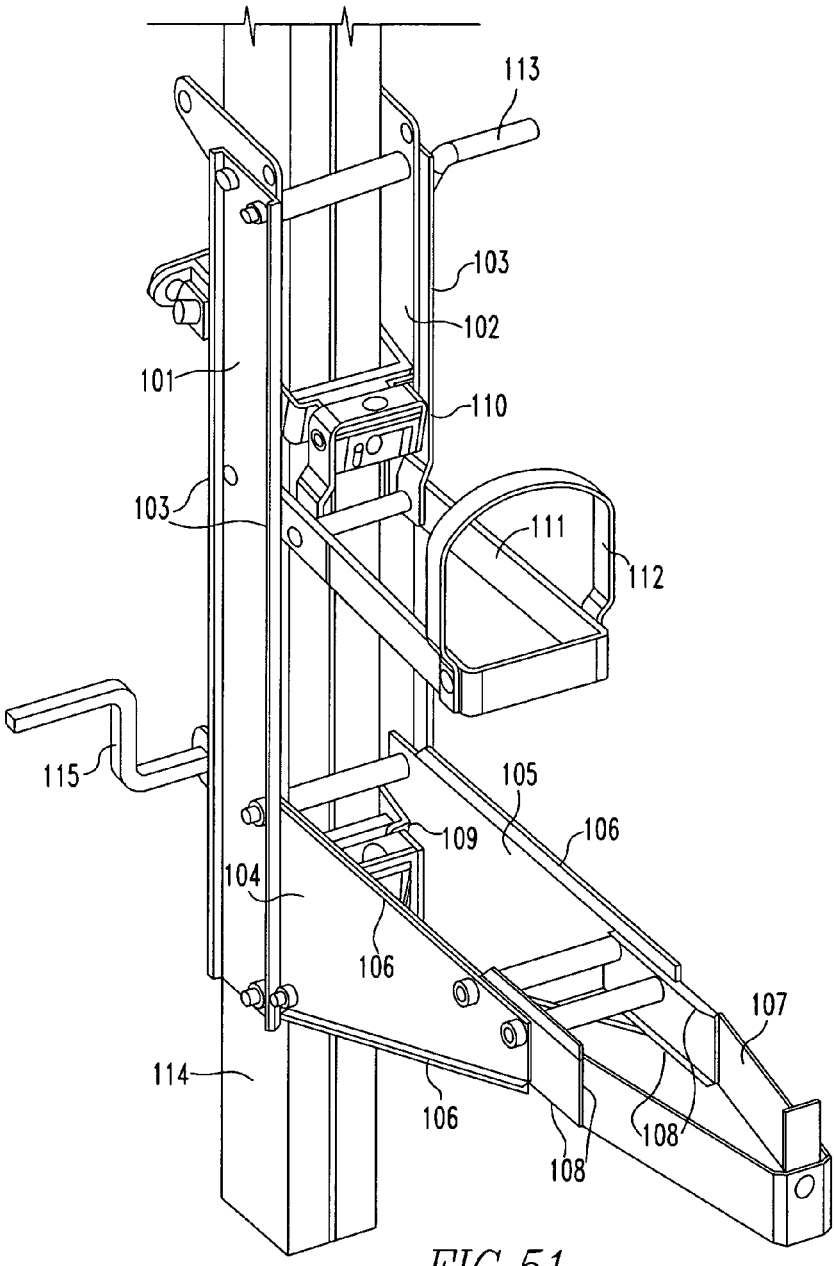
FIG. 51 is a pump jack.

As shown in FIG. 51, the steel pump jack 50 comprises two side supports 101 and 102 with a formed flange 103 along each edge of the side supports 101 and 102, two platform supports 104 and 105 with a formed flange 106 along each edge of the platform supports 104 and 105, a platform extension support 107 with formed flanges 108 along each edge of the platform extension support 107, a lower shackle assembly 109 and an upper shackle assembly 110 with foot pump 111 and boot strap 112. The steel pump jack 50 also contains a formed crank handle 113 for lowering the steel pump jack 50 down the wood pole 114 and a brake system, consisting of a foot lever 115 that can be depressed using a foot.

An upper shackle assembly for a steel pump jack 50 that overcomes this fault is described below. The upper shackle assembly is designed with an additional pole latch feature, which acts as a brake in the case of crank handle 12 failure.

A latch has been designed for an upper shackle assembly of a steel pump jack 50. As shown in FIGS. 1-44, the latch design consists of a latch plate 1 having a first side and a second side. The first side of the latch plate 1 contains an integrally formed latch tab 2, while the second side of the latch contains a slot 3 and an integrally formed cover rib 4. The integrally formed latch tab 2 and cover rib 4 both include holes 5 and 6, respectively. The hole 5 in the latch tab 2 is designed for the placement of a pin 22, such as a cotter pin, to hold the latch plate 1 in place during use. The hole 6 in the cover rib 4 is designed to fit the end 11 of a crank handle 12. The latch plate 1 also has an additional integrally formed rib 14, which acts as a brake against a wood pole 15 in the case of a failure to the crank handle 12.

The latch plate 1 is designed to fit on a primarily u-shaped shackle component 7 with a first side and a second side. The first side of the shackle component 7 contains an open slot 8, while the second side contains an integrally formed attachment surface 9 for attachment of the latch plate 1. The latch assembly consists of the latch plate 1, which is pivotally and slidably attached to the primarily u-shaped shackle component 7 and a means to attach the two members together 10.

The purpose of the cover rib 4 on the latch plate 1 is to cover the square hole 13 on the shackle component 7 when the latch plate 1 is in any position other than the fully closed position. This feature forces the user to ensure the latch plate 1 is in the proper fully closed position during use.

FIG. 1 and FIGS. 5-12 show the latch plate 1 in the open position to allow the steel pump jack 50 to be installed around the wood pole 15. FIG. 2 and FIGS. 13-20 show the latch plate 1 in a partially closed position and FIG. 3 and FIGS. 21-28 show the latch plate 1 in the fully closed position. The operation of attaching the latch plate around the wood pole 15 involves pivoting the latch plate 1 from the open position in FIG. 1 to the partially closed position shown in FIG. 2. The latch plate 1 is then slid into the closed position shown in FIG. 3, wherein the latch plate tab 2 is inserted into the open slot 8 of the shackle component 7. A pin 22, such as a cotter pin, is then inserted into the latch plate tab hole 5 to hold the latch plate 1 in place during use of the steel pump jack 50.

Figure 4:
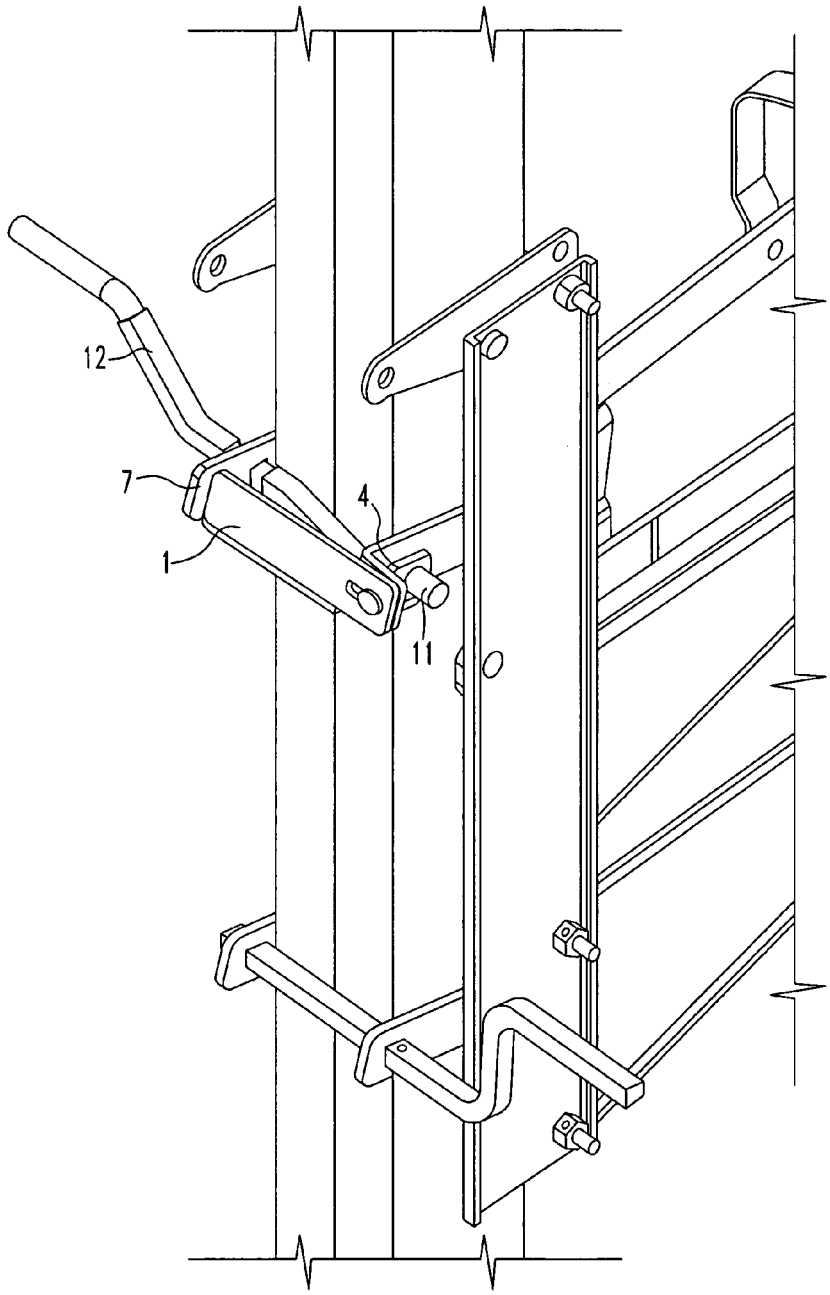
FIG. 4 shows the pump jack in a fully closed position.
Figure 5:
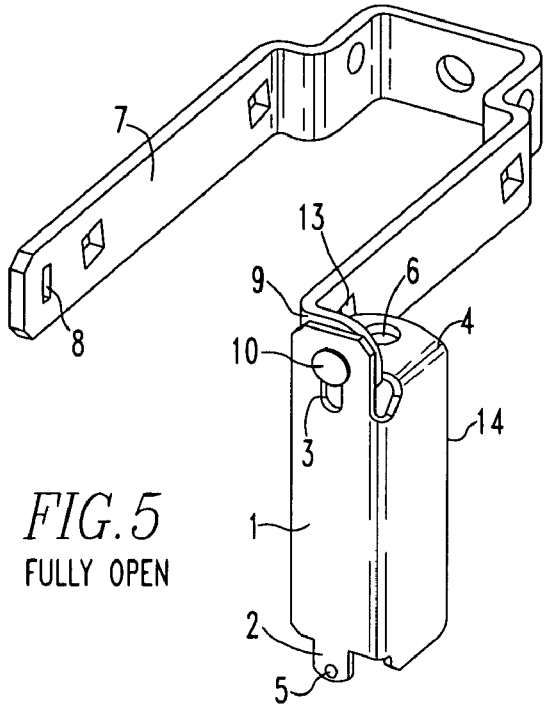
FIG. 5 is a fully open view of the upper shackle assembly.
Figure 6:
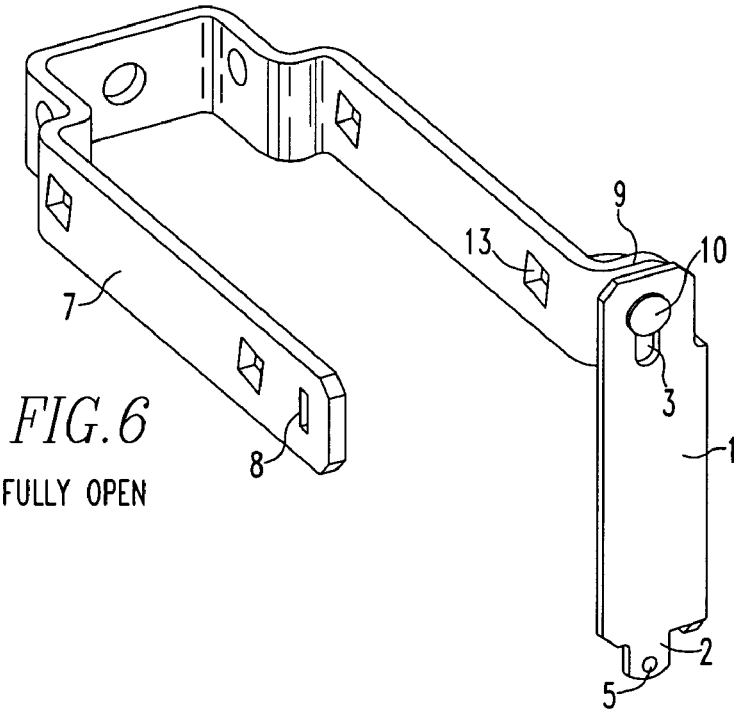
FIG. 6 is a fully open view of the upper shackle assembly.
Figure 7:
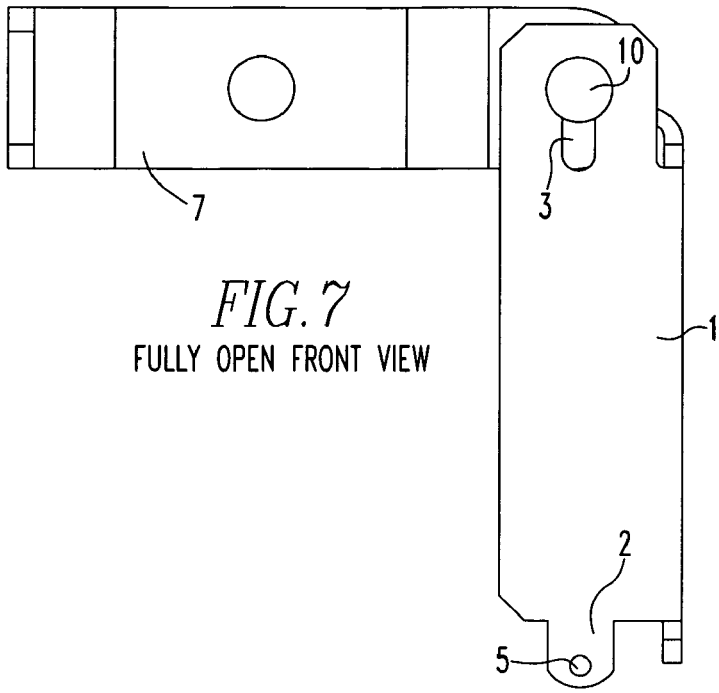
FIG. 7 is a fully open front view of the upper shackle assembly.
Figure 8:
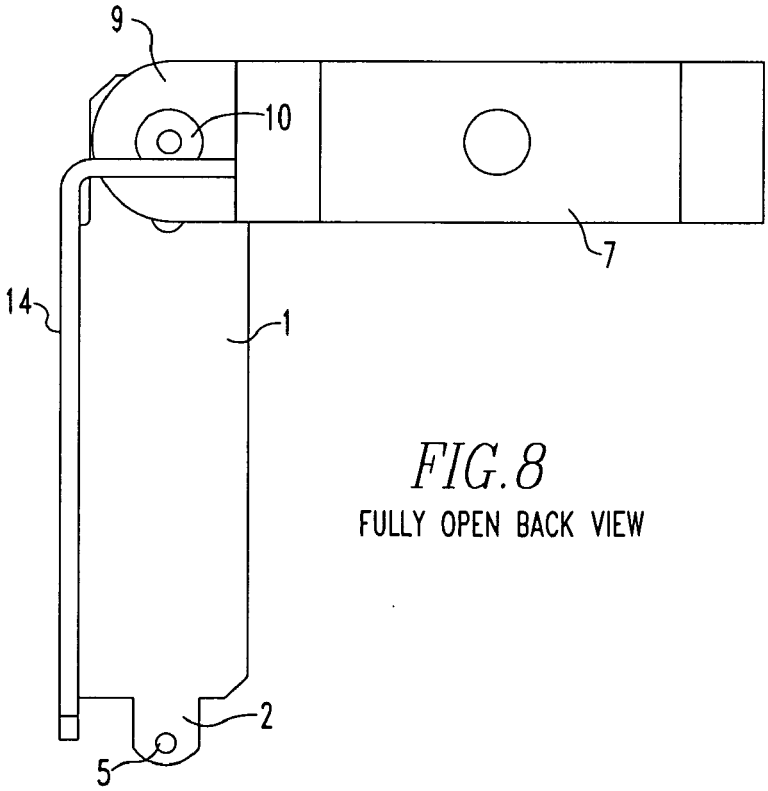
FIG. 8 is a fully open back view of the upper shackle assembly.
Figure 9:
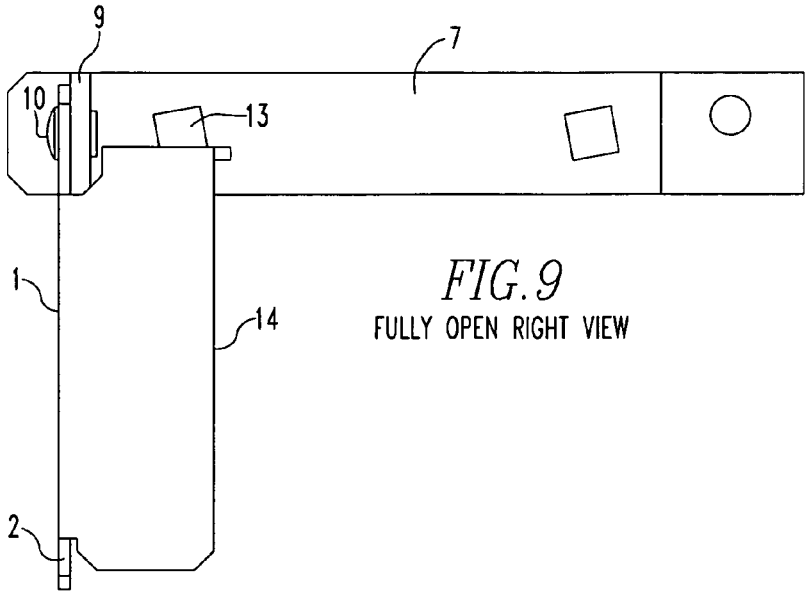
FIG. 9 is a fully open right view of the upper shackle assembly.
Figure 10:
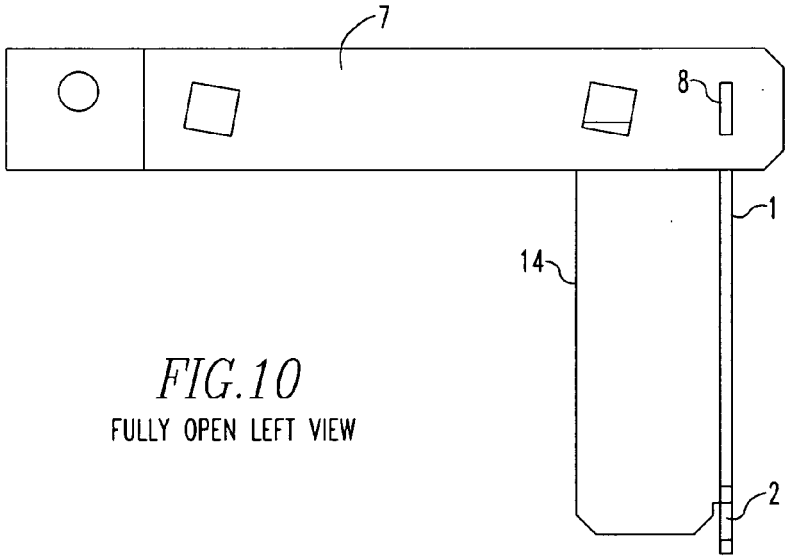
FIG. 10 is a fully open left view of the upper shackle assembly.
Figure 11:
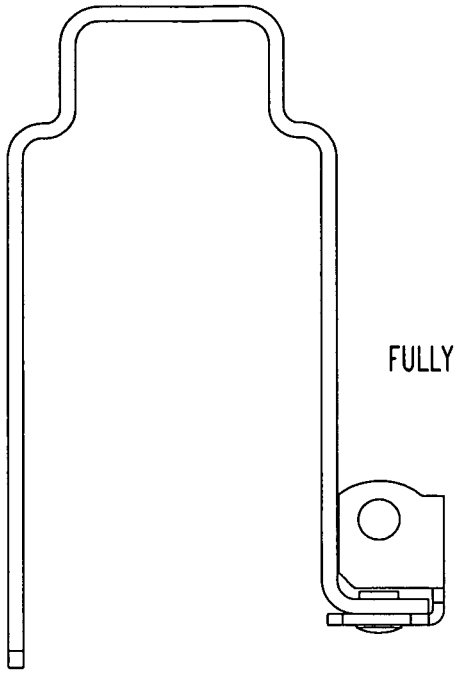
FIG. 11 is a fully open top view of the upper shackle assembly.
Figure 12:
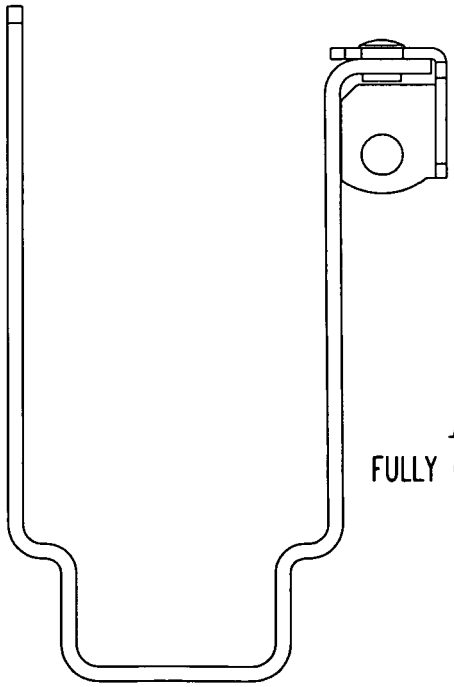
FIG. 12 is a fully open bottom view of the upper shackle assembly.
Figure 13:
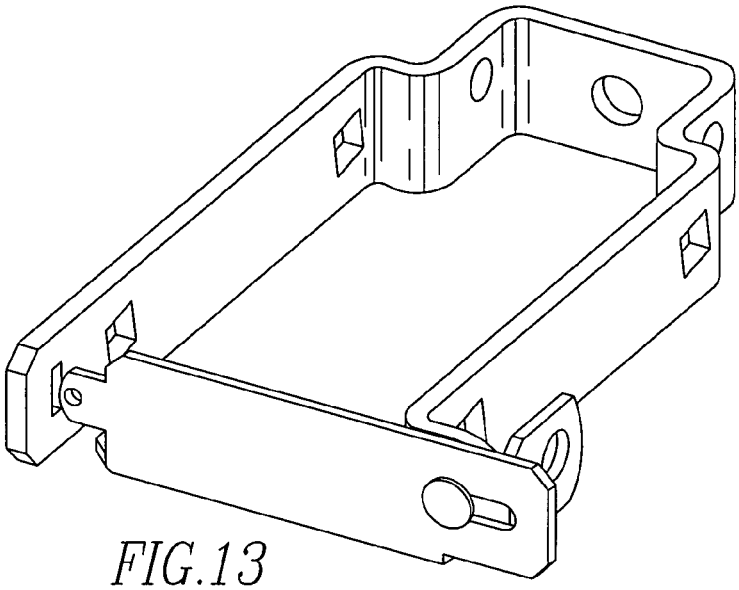
FIG. 13 is a partially open view of the upper shackle assembly.
Figure 14:
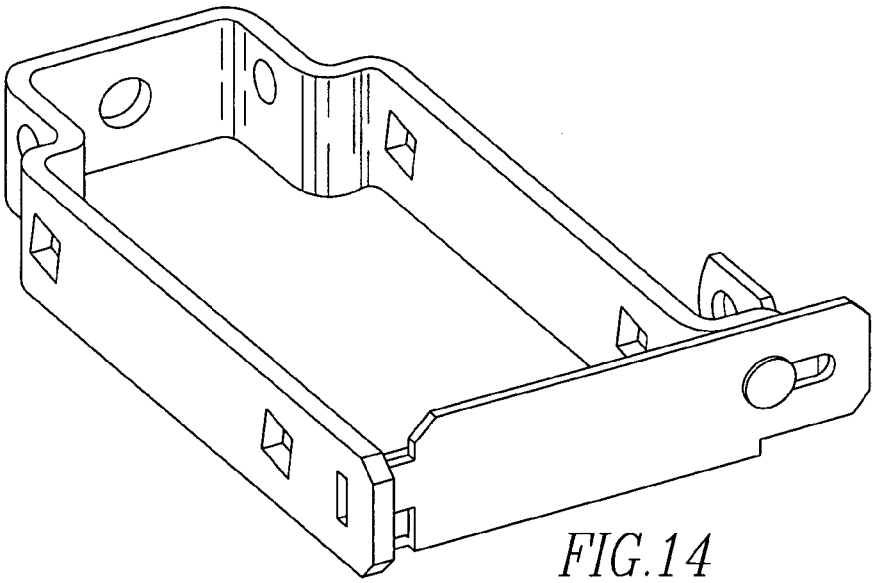
FIG. 14 is a partially open view of the upper shackle assembly.
Figure 15:
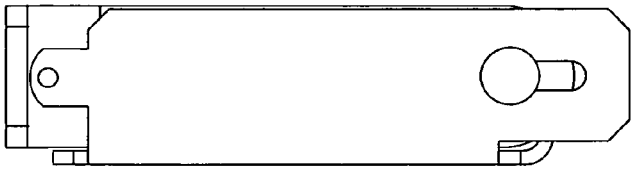
FIG. 15 is a partially open front view of the upper shackle assembly.
Figure 16:
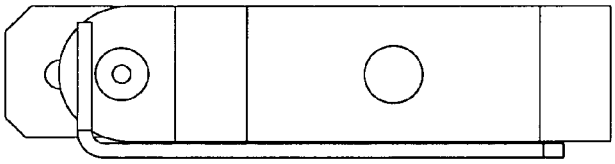
FIG. 16 is a partially open back view of the upper shackle assembly.
Figure 17:
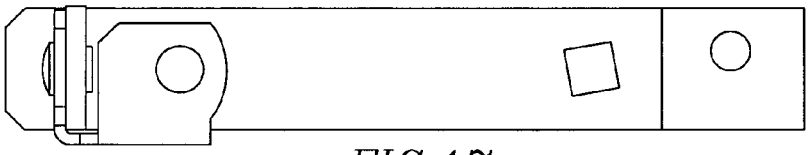
FIG. 17 is a partially open right view of the upper shackle assembly.
Figure 18:
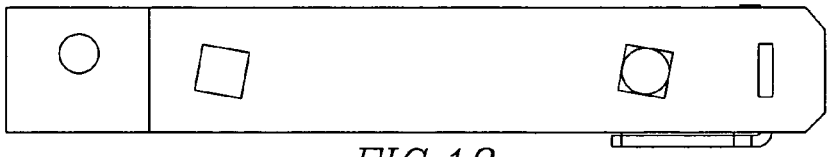
FIG. 18 is a partially open left view of the upper shackle assembly.
Figure 19:
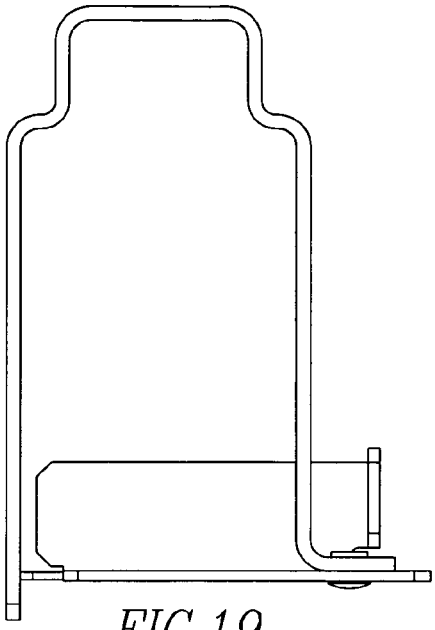
FIG. 19 is a partially open top view of the upper shackle assembly.
Figure 20:
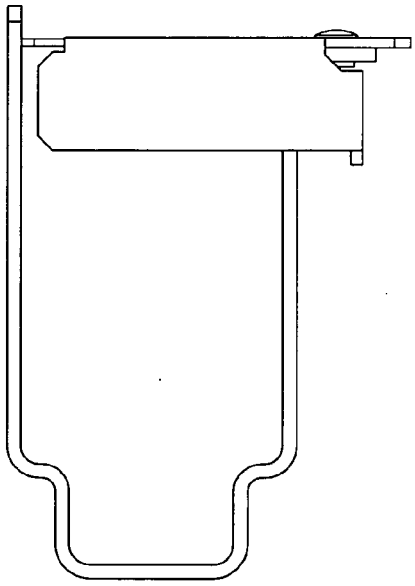
FIG. 20 is a partially open bottom view of the upper shackle assembly.
Figure 21:
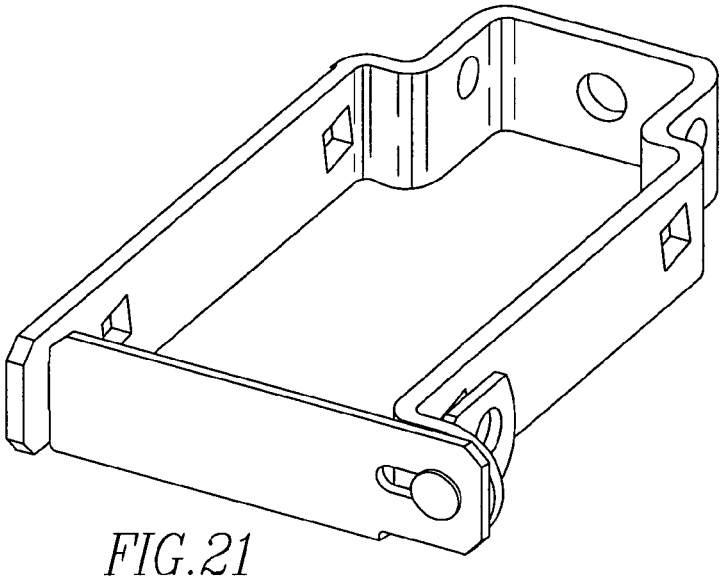
FIG. 21 is a fully closed view of the upper shackle assembly.
Figure 22:
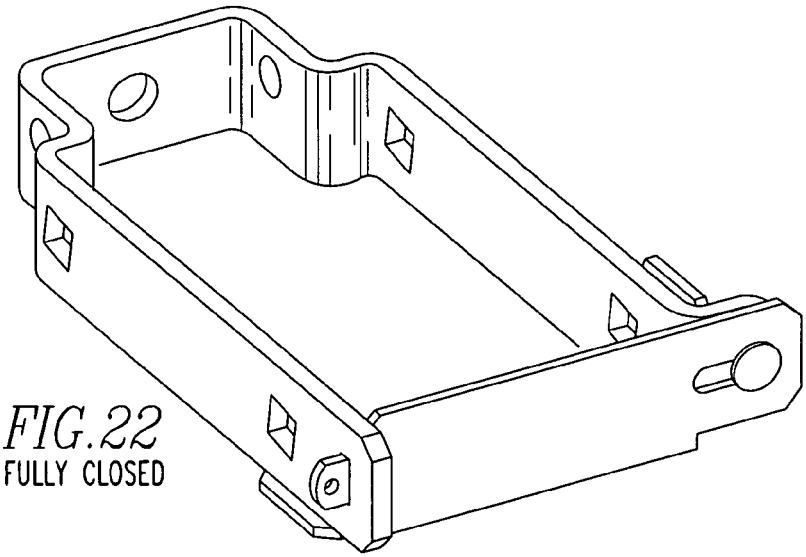
FIG. 22 is a fully closed view of the upper shackle assembly.
Figure 23:
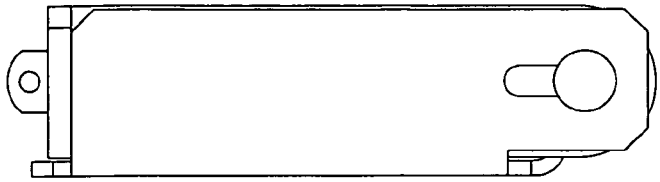
FIG. 23 is a fully closed front view of the upper shackle assembly.
Figure 24:
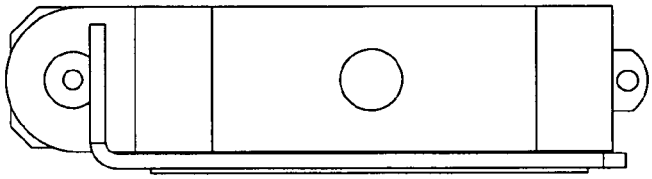
FIG. 24 is a fully closed back view of the upper shackle assembly.
Figure 25:
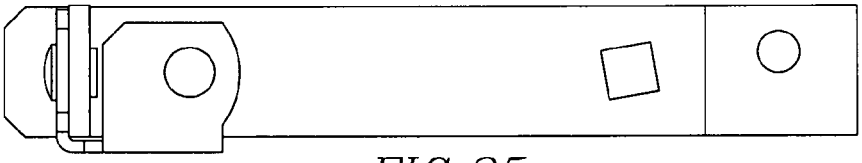
FIG. 25 is a fully closed right view of the upper shackle assembly.
Figure 26:
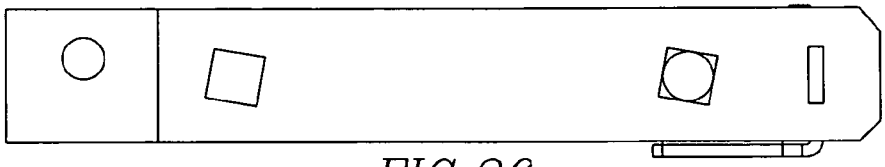
FIG. 26 is a fully closed left view of the upper shackle assembly.
Figure 27:
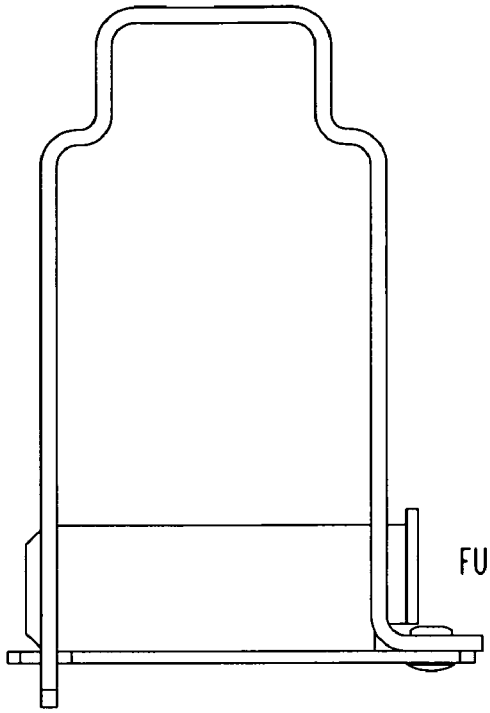
FIG. 27 is a fully closed top view of the upper shackle assembly.
Figure 28:
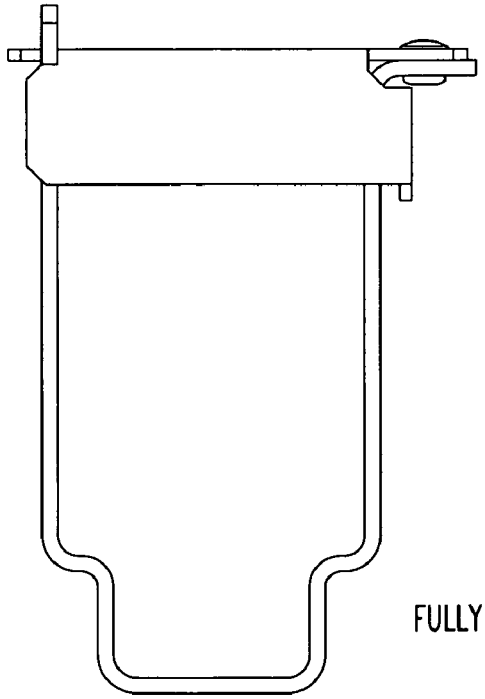
FIG. 28 is a fully closed bottom view of the upper shackle assembly.
Figure 29:
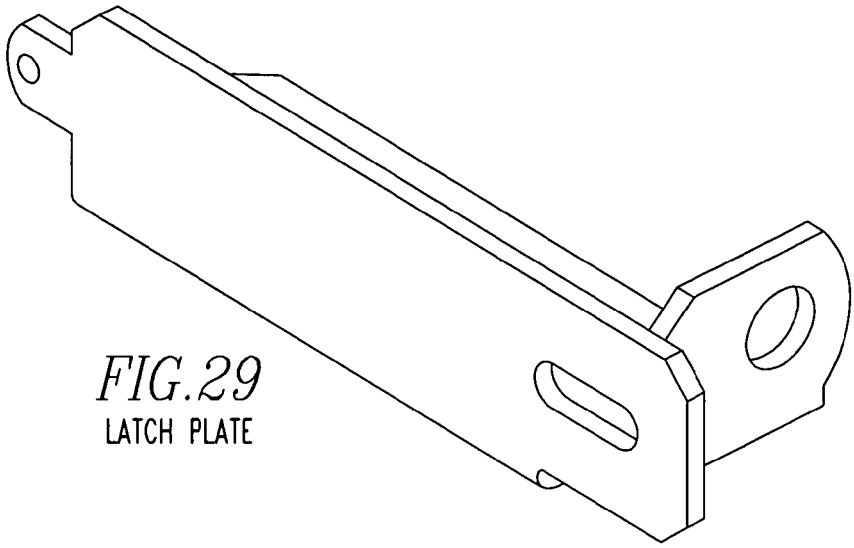
FIG. 29 is a view of the latch plate.
Figure 30:
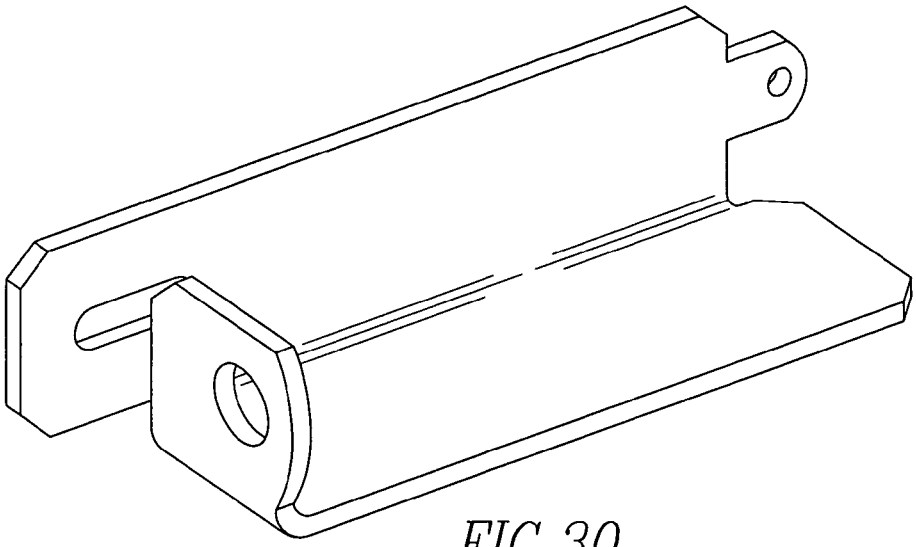
FIG. 30 is a view of the latch plate.
Figure 31:
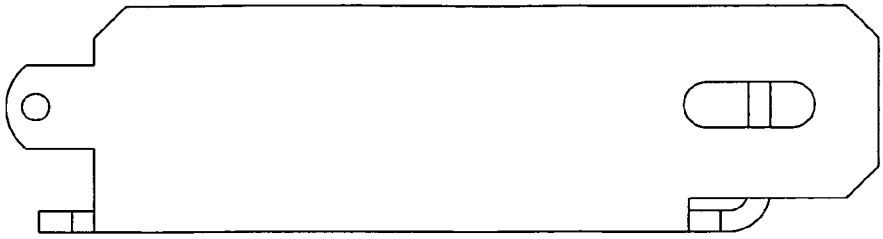
FIG. 31 is a latch plate front view.
Figure 32:
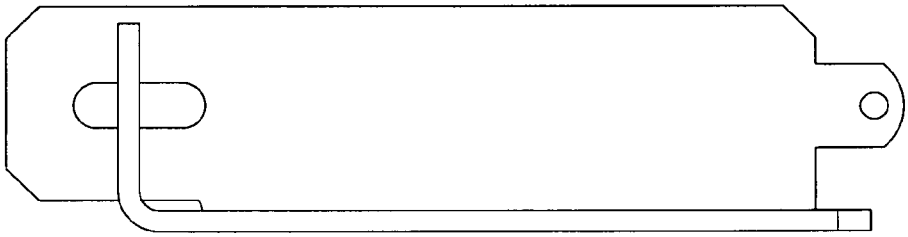
FIG. 32 is a latch plate back view.
Figure 33:
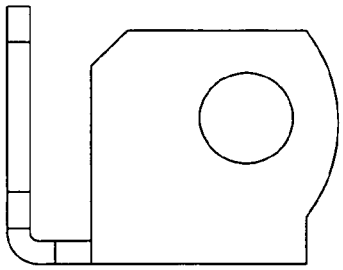
FIG. 33 is a latch plate right view.
Figure 34:
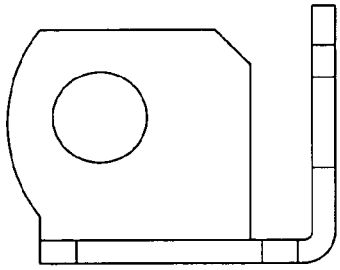
FIG. 34 is a latch plate left view.
Figure 35:
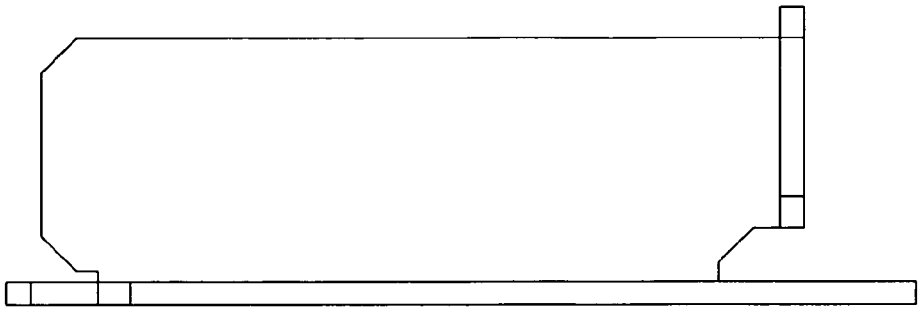
FIG. 35 is a latch plate top view.
Figure 36:
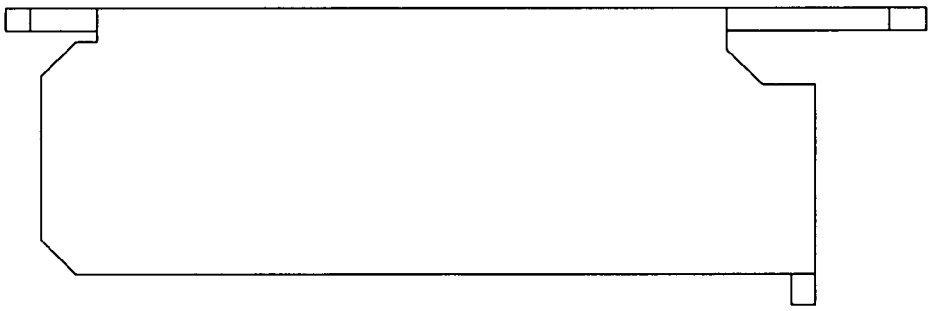
FIG. 36 is a latch plate bottom view.
Figure 37:
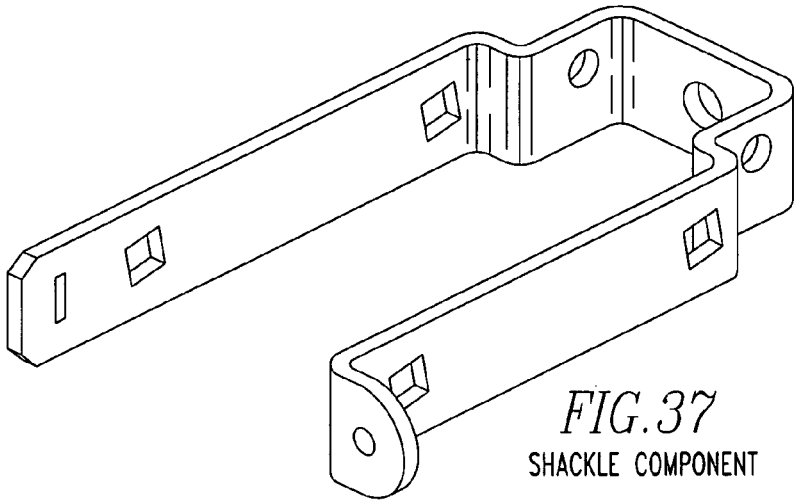
FIG. 37 is a view of the shackle component.
Figure 38:
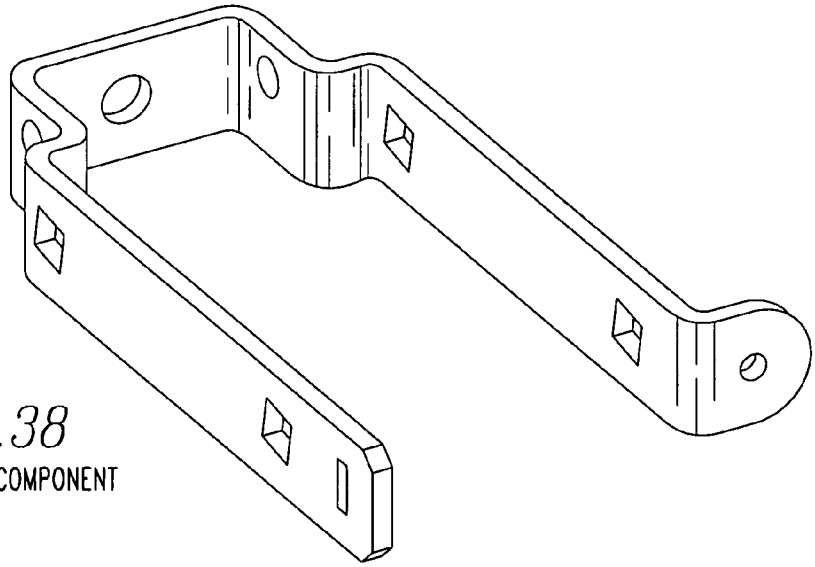
FIG. 38 is a view of the shackle component.
Figure 39:
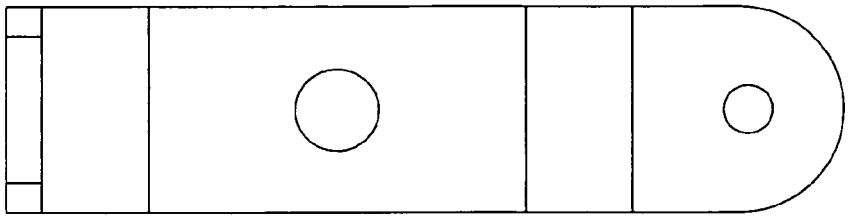
FIG. 39 is a shackle component front view.
Figure 40:
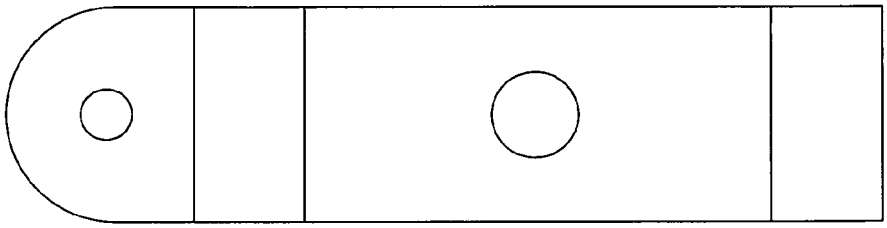
FIG. 40 is a shackle component back view.
Figure 41:
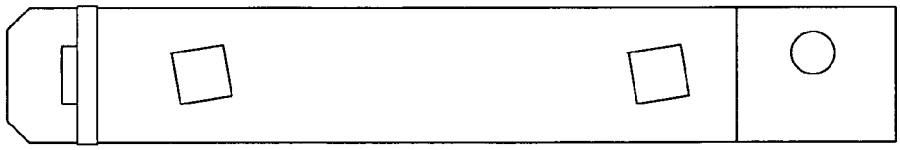
FIG. 41 is a shackle component right view.
Figure 42:
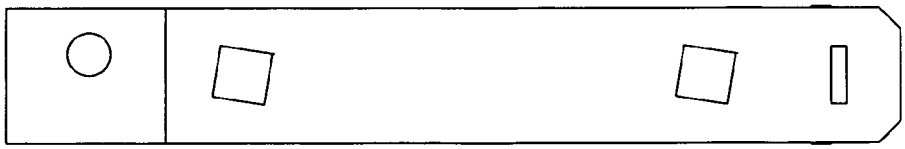
FIG. 42 is a shackle component left view.
Figure 43:
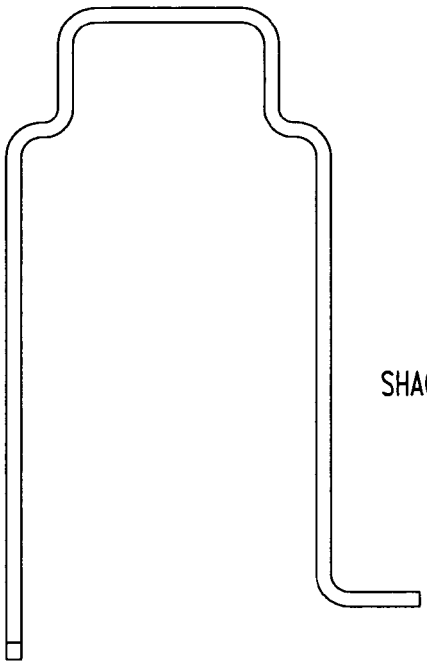
FIG. 43 is a shackle component top view.
Figure 44:
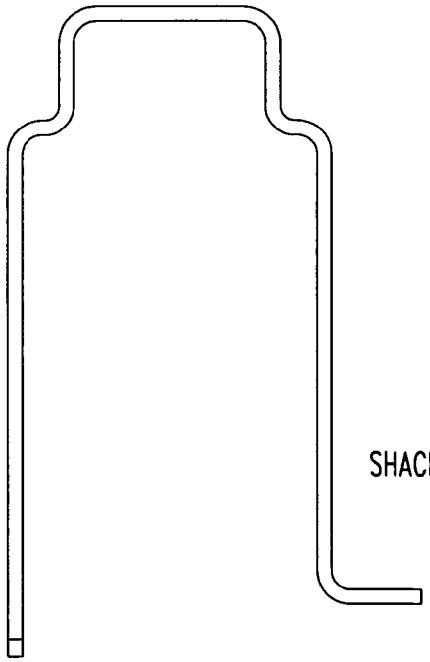
FIG. 44 is a shackle component bottom view.
Figure 45:
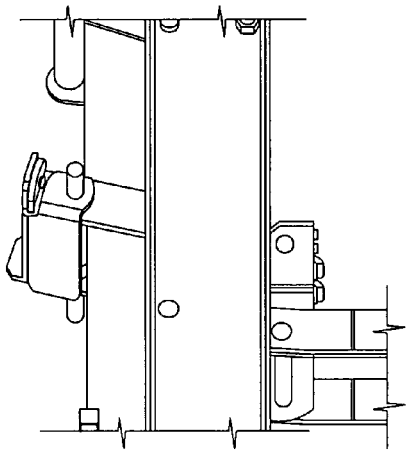
FIG. 45 is a latch plate gap at working angle.
Figure 46:
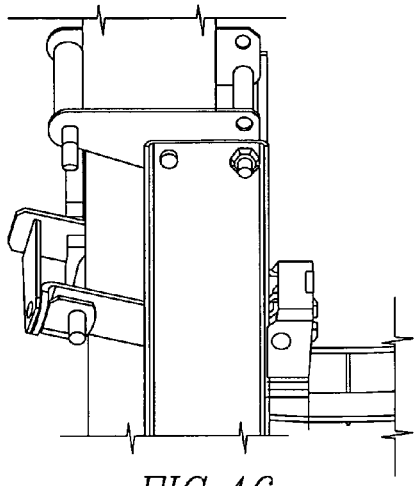
FIG. 46 is a crank handle position at working angle.
Figure 47:
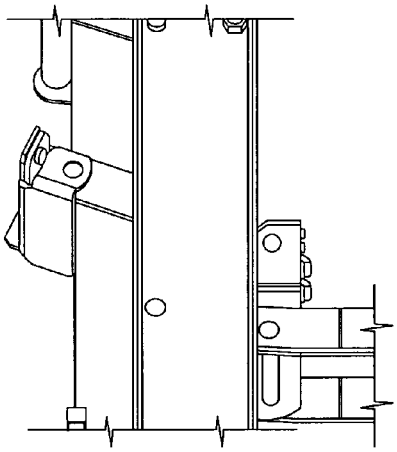
FIG. 47 is a latch plate contact with pole at failure angle.
Figure 48:
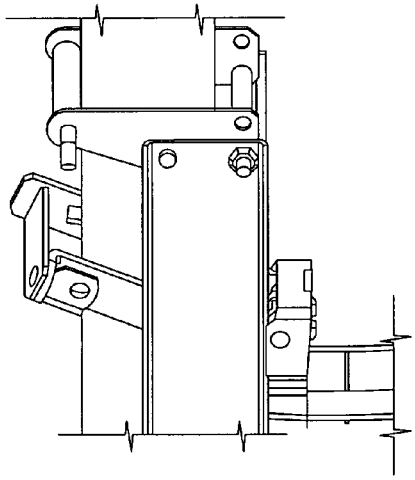
FIG. 48 is a latch plate contact with pole at failure angle.
Figure 49:
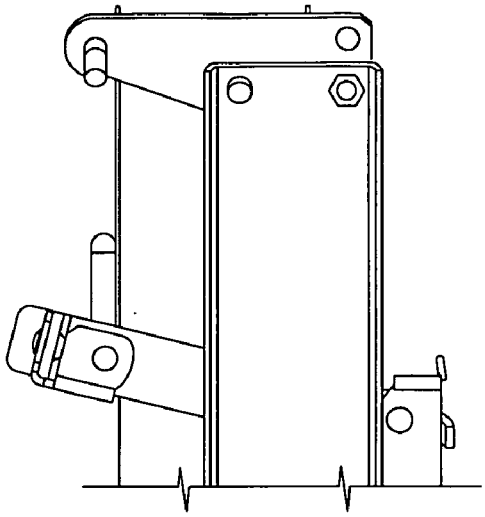
FIG. 49 is a shackle component angle with crank handle.
Figure 50:
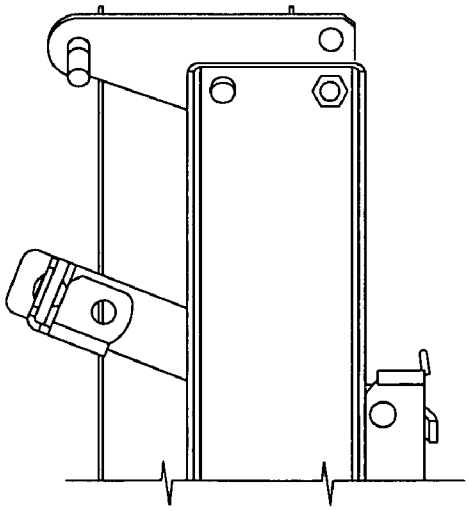
FIG. 50 is a shackle component angle without crank handle.

FIG. 4 shows the latch plate 1 in the fully closed position with a crank handle 12 inserted through the square hole 13 in the shackle component 7 and through the hole 6 of the latch plate cover rib 4.

As shown in FIGS. 45 through 50, the latch plate 1 does not make contact with the wood pole 15, due to the angle of the shackle component 7 when the crank handle 12 is installed. The crank handle 12 holds the shackle component 7 at a shallow angle. In the case of a failure of the crank handle 12, the shackle component 7 will rotate up at a greater angle, causing the integrally formed rib 14 of the latch plate 1 to contact the wood pole 15 and act as a brake. The angle of the shackle component 7 then causes the latch plate 1 to bind against the wood pole 15 and will not allow the steel pump jack 50 to slide down the wood pole 15.

Although the invention has been described in detail in the foregoing embodiments for the purpose of illustration, it is to be understood that such detail is solely for that purpose and that variations can be made therein by those skilled in the art without departing from the spirit and scope of the invention except as it may be described by the following claims.

What is claimed is:

1. An upper shackle assembly for a steel pump jack for a wood pole comprising:

a u-shaped shackle component capable of receiving the wood pole;

a crank handle that extends through the shackle component and capable of engaging the pole to lower the pump jack down the pole; and a brake attached to the shackle component capable of engaging with the pole if the crank handle fails, the brake includes a latch plate having a first side and a second side, the first side has a latch tab and the second side has a slot and a cover rib, the latch tab has a hole and the cover rib has a hole, the brake includes a pin which fits through the latch tab hole to hold the latch plate in place when the latch plate is closed with the u-shaped shackle component, the hole in the cover rib receives the end of the crank handle.

2. An assembly as described in claim 1 wherein the latch plate includes a rib capable of catching the wood pole if the crank handle fails.

3. An assembly as described in claim 2 wherein the shackle component includes a first side with an open slot through which the latch tab extends in a closed position, and a second side having an attachment surface from which a rivet extends through the slot of the latch tab so the latch plate can slide and pivot with respect to the attachment surface.

4. An assembly as described in claim 3 wherein the second side of the shackle component includes a square hole at least partially obstructed by the cover rib when the latch plate is not in the closed position and to ensure the latch plate is in the closed position during use.

* * * * *